US006581800B2

(12) United States Patent
Rodd et al.

(10) Patent No.: US 6,581,800 B2
(45) Date of Patent: Jun. 24, 2003

(54) APPARATUS FOR HOLDING AND METERED DISPENSING OF AT LEAST ONE ACTIVE COMPOSITION INTO A WASHING MACHINE, A LAUNDRY DRYER OR A DISHWASHING MACHINE

(75) Inventors: Timothy Rodd, Sandy Lane Lyndhurst (GB); Graham Fuller, Cranfield (GB); Peter T. M. Nott, Bath (GB); Richard Harbutt, Old Windsor (GB)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/053,816

(22) Filed: Jan. 22, 2002

(65) Prior Publication Data

US 2002/0108969 A1 Aug. 15, 2002

Related U.S. Application Data

(63) Continuation of application No. PCT/EP00/06889, filed on Jul. 19, 2000.

(30) Foreign Application Priority Data

Jul. 23, 1999 (DE) ..... 199 34 593

(51) Int. Cl.[7] ..... D06F 39/02

(52) U.S. Cl. ..... 222/54; 222/83; 222/83.5; 222/144; 68/12.03

(58) Field of Search ..... 222/52, 54, 651, 222/652, 83, 83.5, 144; 68/12.03

(56) References Cited

U.S. PATENT DOCUMENTS

| | | | | | |
|---|---|---|---|---|---|
| 3,028,051 | A | * | 4/1962 | Jacobs | 222/41 |
| 3,094,247 | A | * | 6/1963 | Marchi | 222/54 |
| 3,212,675 | A | * | 10/1965 | Krzewina | 222/652 |
| 3,584,763 | A | * | 6/1971 | Donselman | 222/54 |
| 4,014,432 | A | | 3/1977 | Clothier et al. | |
| 4,379,515 | A | | 4/1983 | Towsend | |
| 4,732,191 | A | * | 3/1988 | Visser et al. | 222/54 |
| 5,033,643 | A | | 7/1991 | Schumacher | |
| 5,133,487 | A | * | 7/1992 | Russi | 222/54 |
| 5,176,297 | A | | 1/1993 | Mooney et al. | |
| 6,143,257 | A | * | 11/2000 | Spriggs et al. | 222/54 |
| 6,223,937 | B1 | * | 5/2001 | Schmidt | 222/54 |

FOREIGN PATENT DOCUMENTS

| | | |
|---|---|---|
| AU | A-78393/91 | 1/1992 |
| DE | 39 02 356 A1 | 8/1990 |
| DE | 39 22 342 A1 | 1/1991 |
| DE | 39 34 123 A1 | 4/1991 |
| DE | 195 40 608 A1 | 5/1997 |
| DE | 197 40 819 A1 | 3/1999 |
| EP | 0 215 366 A2 | 3/1987 |
| EP | 0 328769 A1 | 8/1989 |
| EP | 0 461 870 A2 | 12/1991 |

* cited by examiner

*Primary Examiner*—Kenneth Bomberg
(74) *Attorney, Agent, or Firm*—Akin Gump Strauss Hauer & Feld, L.L.P.

(57) ABSTRACT

An apparatus for holding and dispensing metered doses of at least one active composition in a washing machine, a dryer or a dishwasher has at least two separate compartments for respectively receiving and dispensing an active composition and an opening mechanism for the compartments, which is operated by means which are activated by conditions prevailing in the inside of the machine. These conditions prevail solely in the course of a washing, drying or dishwashing cycle. The position of the opening mechanism and/or the compartment(s) after emptying of at least one compartment is changed relative to each other, such that the opening mechanism can then open at least one other compartment, when another activation occurs.

16 Claims, 3 Drawing Sheets

APPARATUS FOR HOLDING AND METERED DISPENSING OF AT LEAST ONE ACTIVE COMPOSITION INTO A WASHING MACHINE, A LAUNDRY DRYER OR A DISHWASHING MACHINE

CROSS-REFERENCE TO RELATED APPLICATIONS

This application is a continuation of International Application No. PCT/EP00/06889, filed Jul. 19, 2000, the disclosure of which is incorporated herein by reference.

BACKGROUND OF THE INVENTION

The invention is directed to an apparatus for holding and dispensing metered amounts of at least one active composition into a washing machine, a laundry dryer or a dishwashing machine.

Already known from German published patent application DE 197 40 819 A1 is a metering and dispensing device inside a mechanism designed to add powdered detergent in doses to water-operated washing machines. The device is provided with two compartments disposed in one plane for receiving the powdered detergent, which is discharged into a processing container of the washing machine. The compartments have filling openings, through which any individual or all of the compartments can be selectively filled with the powdered detergent. The filling openings communicate with an outlet opening of a funnel-shaped detergent hopper mechanism and simultaneously serve as individually activatable openings for the purpose of dispensing to the rinsing or washing water, co-operating with synchronously controllable outlet openings for the water admixed with the powdered detergent. The individual doses of detergent are discharged by a manual setting operated by the user or by an operating program selected by the user.

U.S. Pat. No. 4,379,515 discloses a dispensing device for detergent, comprising a rigid container and, communicating with this rigid container by means of a pipe, a compressible reservoir containing the measured quantity of detergent needed for one washing cycle. Under the effect of centrifugal forces generated by rotation of the laundry drum, the reservoir is compressed—particularly if it is disposed between the laundry and the wall of the laundry drum—in such a way that its contents are emptied into the rigid container, where the detergent is then dissolved by the washing liquor. A disadvantage of this dispensing system resides in the fact that the reservoir can be used for only one respective washing cycle and has to be replaced with each new washing cycle.

European patent publication EP 0 215 366 describes a detergent container with a welded seal, wherein the welded seal melts at a specific operating temperature and then releases the detergent. The seal of the container in particular cannot be used again and, in addition, it is not possible to dispense more than once with this system.

European patent publication EP 0 328 769 describes a removable dispensing container with a closure that can be opened during a washing cycle and which has a manipulating extension. The pressure exerted by the laundry during the washing cycle causes the manipulating extension to be pushed into the dispensing container in such a way that the detergent is able to flow out. It is not possible to dispense more than one dose, and the dispensing container must be filled again before each washing cycle.

German patent publication DE 39 02 356 discloses a dispensing container which may be used for a single washing cycle only and operates on the basis of a temperature-dependent release of a liquid fabric conditioner. The rising temperature causes the pressure in the dispensing container to rise above atmospheric pressure, as a result of which a gate valve is displaced into its open position, permitting the liquid fabric conditioner to flow into the washing machine.

U.S. Pat. No. 5,033,643 describes a dispensing container, which also allows a metering unit to be released for only one washing cycle. Forces generated by the wet laundry act on the release mechanism of the dispensing container.

German patent publications DE 39 34 123 and DE 39 22 342 describe detergent containers which are fixedly mounted on the laundry drum. Pins or locking hooks are used for fixing purposes. With these containers, no provision is made for more than one dose, which means that they have to be removed from the washing machine after every washing cycle and re-filled.

U.S. Pat. No. 5,176,297 describes a dispensing system for a dishwasher, which is mounted in the interior of the machine and incorporates a supply and a dispensing compartment. Although it is possible to dispense more than one dose, the dispensing system is controlled by the dishwasher in a complex manner.

German patent publication DE 195 40 608 discloses a system enabling more than one dose to be dispensed, in which tablets of dishwasher detergent are placed. The individual doses are controlled by a command issued by the dishwasher, i.e. an operating program of the dishwasher selected by the user controls the time at which the dose is released.

Australian published patent application AU-A-78393/91 discloses a dispensing container for a detergent, which is dispensed through an orifice opened by the build-up of internal pressure in the container. This internal pressure is generated either by the operating program of the machine or by operation directly on the part of the user.

Summing up the state of the art, dispensing systems are known which primarily permit individual doses to be dispensed and in a few cases multiple doses. In systems permitting a single dose, the release of detergent is generally operated on the basis of a delayed release, which may be triggered by means of a rise in temperature, an increase in pressure or centrifugal forces, for example. What systems permitting multiple doses have in common is that the release is mechanically triggered (valve, piston, gate, etc.), either on the basis of a command issued by the washing program of the machine or by direct operation on the part of the user.

BRIEF SUMMARY OF THE INVENTION

An underlying objective of the invention is to propose an apparatus for holding and dispensing doses of at least one active composition into a washing machine, a laundry dryer or a dishwasher. The apparatus enables more than one dose to be dispensed (in either one or more laundry washing, drying or dishwasher rinse cycles) and is triggered independently of the commands of an operating program in the machine or intervention by the user.

This objective is achieved by the invention in that at least two separate compartments are provided for respectively receiving and dispensing at least one active composition. An opening mechanism is provided for the compartments, which is operated by means that are activated by conditions prevailing in the interior of the machine, which occur exclusively during a laundry washing, drying or dishwashing cycle. For this purpose, the position of the opening mechanism and/or the compartment(s) relative to one another is altered after at least one respective compartment has been emptied, thereby enabling at least one other respective compartment to be opened by the opening mechanism when activated again.

A preferred embodiment is wherein a first bellows; a second bellows; a connecting pipe with a one-way valve which connects the two bellows to one another; and a hydraulic fluid which is released from the first bellows into the second bellows causing the latter to expand. The opening mechanism is connected to the second bellows in such a way that it is raised due to the expansion of the second bellows, the opening mechanism being so designed that its lifting action causes the compartment(s) to open to the degree that the compartment contents can be substantially entirely dispensed into the machine. This embodiment also includes means which enable the hydraulic fluid gradually to leave the second bellows and a return mechanism connected to the opening mechanism, which enables the opening mechanism to be repositioned as the hydraulic fluid gradually leaves the second bellows, the opening mechanism being guided into a position such that, when activated again, the or other compartment(s) can be opened in the same manner.

In accordance with the invention, the release of hydraulic fluid from the first bellows to the second bellows is operated, directly or indirectly, by rotation of the apparatus with the washing machine or dryer drum. In one especially preferred embodiment of the invention, as the apparatus is rotated with the washing machine or dryer drum, a pivotably secured weight compresses the first bellows, causing the hydraulic fluid to be released to the second bellows. In an alternative embodiment of the invention, the hydraulic fluid is released from the first bellows to the second bellows due to the wet laundry or dry laundry compressing the first bellows directly or indirectly.

Another embodiment of the invention is characterized in that the opening mechanism is raised, directly or indirectly, by means which are altered in form, at least to a certain degree, when the temperature is increased, until at least one compartment has been opened wide enough for the compartment contents to be essentially entirely released into the machine. The means undergo the reverse change of form, at least to a certain degree, on cooling, so that the opening mechanism is guided into a position from which the or other compartment(s) can be opened in the same manner when activated again.

An alternative to this embodiment of the invention is characterized by a rigid compartment with a material disposed therein, which expands as the temperature increases and shrinks on cooling, in particular a wax. Preferably, the opening mechanism is raised by means of a flexible diaphragm, which responds to the expansion of the material. Another alternative to the embodiment of this invention which reacts to the effect of temperature is wherein a bimetallic strip, which bends when the temperature increases and returns to shape on cooling.

Particularly preferably, the opening mechanism is guided into its new position by means of a key groove and a nose co-operating therewith. The opening mechanism preferably has at least one blade or a tongue.

In one particularly practical arrangement, the apparatus is firmly but detachably secured in the interior of the machine. Preferably, the apparatus comprises a cartridge with four to fifteen, more preferably ten, compartments, the compartments preferably being laid out in a circular arrangement in the cartridge.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
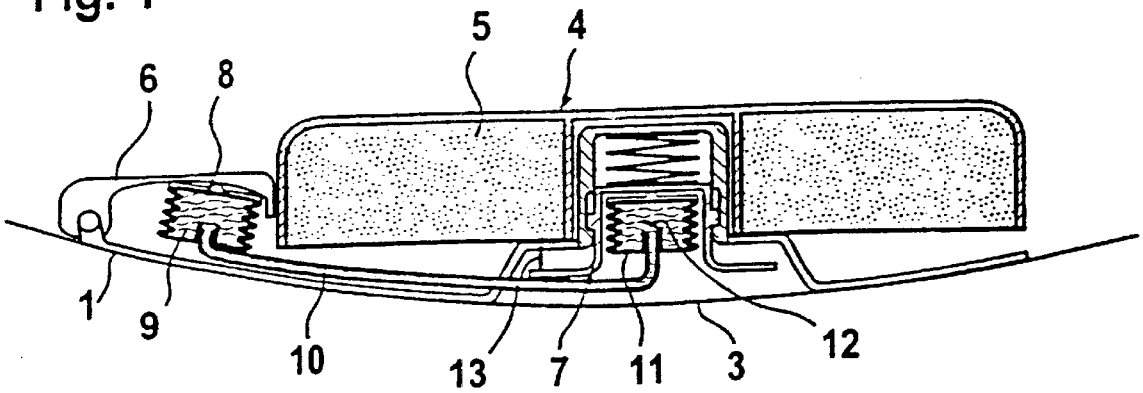
FIG. 1 is a vertical cross sectional view through one embodiment of an apparatus proposed by the invention in a non-dispensing state.
Figure 2:
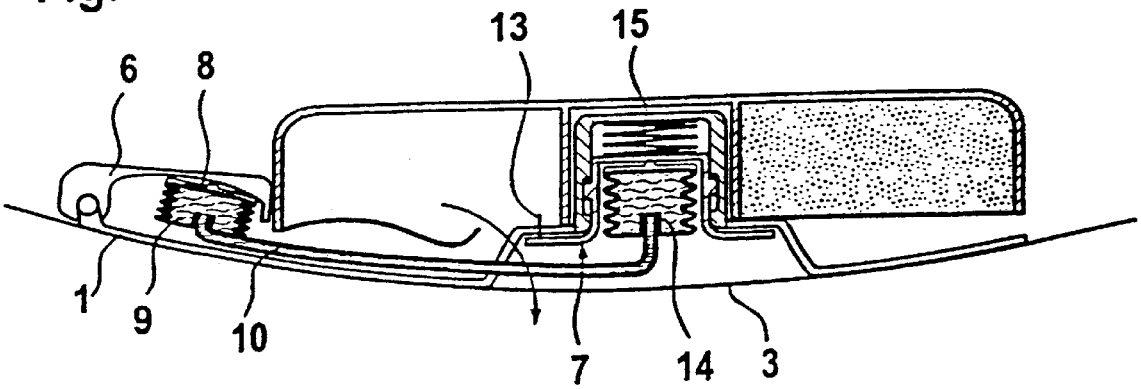
FIG. 2 is a view similar to FIG. 1 showing the apparatus in a dispensing state.
Figure 3:
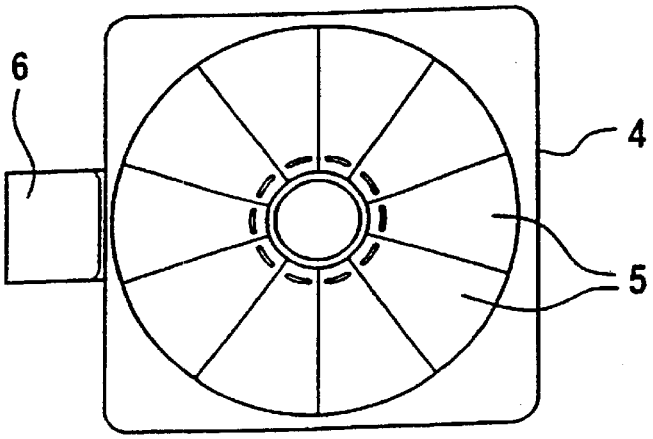
FIG. 3 is a plan view of an embodiment of an apparatus proposed by the invention.

Turning more specifically to FIGS. 1 and 2, an apparatus as proposed by the invention comprises a base plate 1, which is securely (but detachably) fastened in the machine by a holder (e.g., locking hooks or expanding pins, not shown), e.g., on the inside wall 3 of a laundry drum, and a cartridge 4 comprising, for example, ten compartments 5 for receiving at least one active composition. The base plate 1 additionally has a pivotably mounted release mechanism 6 and a rotating opening mechanism 7 for opening the individual compartments. The compartments 5 in the cartridge 4 are arranged in a circle (FIG. 3).

With the embodiment illustrated in FIGS. 1 and 2, wet laundry or dry laundry exerts pressure on the release mechanism 6, in particular due to the rotation of the washing machine or dryer drum. As a result, a first bellows 8 disposed underneath is compressed and the hydraulic fluid 9 (preferably water) disposed in the bellows is released through a connecting pipe 10 to a second bellows 11. As this happens, the hydraulic fluid 9 flows through a one-way valve 12, which prevents the fluid from flowing back out of the second bellows 11. As the bellows 8 is compressed, the second bellows 11 expands in stages.

Figure 4:
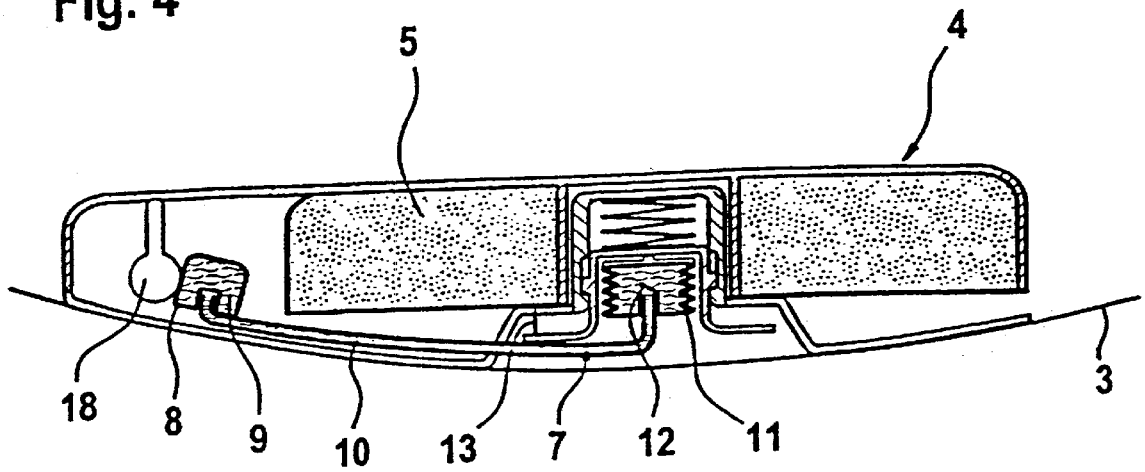
FIG. 4 is a vertical cross sectional view of another embodiment of an apparatus proposed by the invention.

In an alternative embodiment (FIG. 4), the rotation of the washing machine or dryer drum pushes a pivotably suspended weight 18 against the first bellows 8, thereby causing the hydraulic fluid 9 disposed in the first bellows to be released into the second bellows 11 in the same manner.

As it expands, the second bellows 11 raises an opening mechanism 7 with a blade or a tongue 13, which then damages a compartment 5 containing an individual dose of active composition in such a way that it is torn open and its contents are released into the machine. The important factor is that the material encasing the compartment should be of an appropriate type which can be opened by the blade or tongue 13. This encasing material (e.g., thin plastic film) should therefore be easy to puncture or pierce.

It goes without saying that the opening mechanism 7 may also be designed so that it has more than one blade or tongue 13 in order to damage and hence open either one compartment at several points or several compartments simultaneously. The latter situation would enable different active compositions contained in different compartments to be dispensed simultaneously or allow incompatible components to be kept separate from one another.

Once the compartment has been emptied, the hydraulic fluid 9 is slowly able to flow out of the second bellows 11 through a small orifice 14, causing the opening mechanism to be lowered by means of a return spring 15 and at the same time placed by means of a zig-zag mechanism, comprising a key groove 16 and a nose 17 co-operating therewith (FIG. 8), in a position from which one or several other compartment(s) 5 may be opened on re-activation. Once all compartments 5 of the cartridge 4 are spent, the latter can be easily replaced by a new one.

In one embodiment of the invention, the opening mechanism can be re-positioned by dimensioning the orifice 14 or return force of the spring 15 in such a manner that this repositioning action does not take place until completion of the laundry washing, drying or dish-washing cycle, i.e., only one respective compartment is opened during a cycle. In this embodiment, the compartments usually contain the same active composition and do so in a respective amount specifically measured for one cycle.

In another embodiment of the invention, consecutive compartments 5 of the cartridge 4 are filled with different compositions and are opened one after the other during a cycle. For example, a first compartment might be filled with a detergent for the main washing cycle of a washing machine, and a subsequent compartment might be filled with a fabric conditioner for a rinsing cycle.

In this embodiment, the dimensioning of the orifice 14 and the return force of the spring 15 must be selected so that the opening mechanism is repositioned on completion of the main washing cycle to enable renewed activation during the rinsing cycle. It would also be conceivable to cause several activations during one phase of the laundry washing, drying or dish-washing cycle, provided steps are taken to ensure that the hydraulic fluid can flow back out of the bellows 11 relatively quickly, in order to ensure that the opening mechanism can be activated rapidly again.

Figure 5:
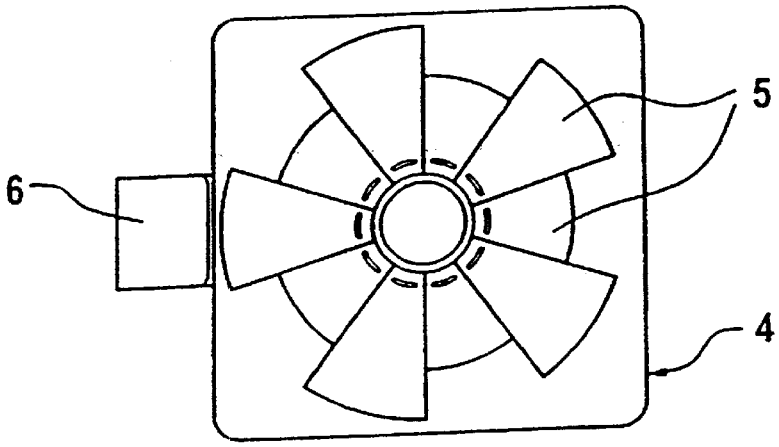
FIG. 5 is a plan view in of another embodiment of an apparatus proposed by the invention.

If the cartridge 4 contains several compartments with different compositions, which are to be released during a single laundry washing, drying or dishwashing cycle, these compartments need not necessarily be of the same size. Accordingly, the compartments may be designed as illustrated in FIG. 5. The mechanism for guiding the opening mechanism 7, such as the aforementioned zig-zag mechanism, may also be designed so that the opening mechanism 7 is guided into the correct respective position for opening the next compartment even if the compartments 5 are of a different design. If a cartridge incorporates compartments with different compositions intended to be released within one cycle, steps must be taken (for example by means of an indentation or the like) to ensure that the cartridge 4 is always attached to the base plate 1 in the correct position from which the dispensing sequence will be correctly timed.

Figure 6:
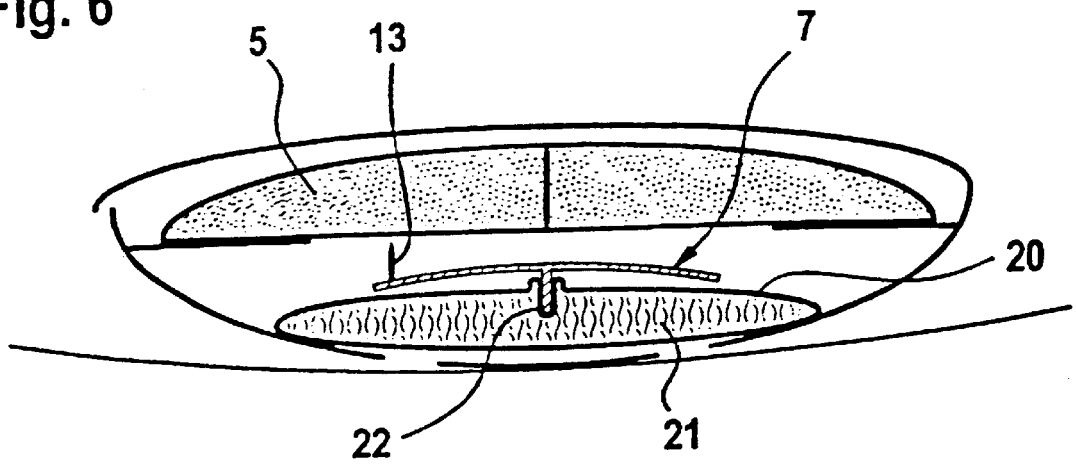
FIG. 6 is a vertical cross sectional view of yet another embodiment of an apparatus proposed by the invention, shown in a non-dispensing state.
Figure 7:
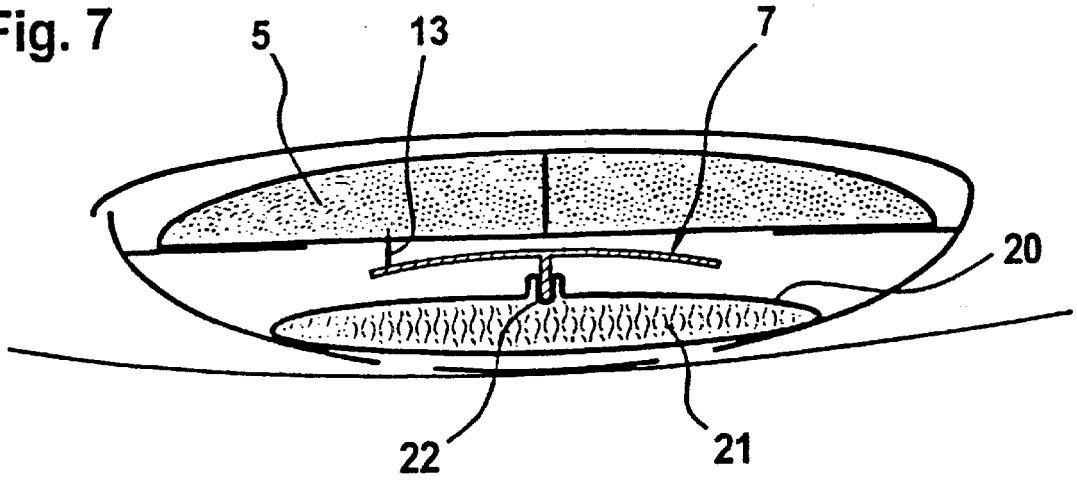
FIG. 7 is a view similar to FIG. 6 showing the apparatus in a dispensing state.

In another embodiment of the invention (illustrated in FIGS. 6 and 7), the system is activated depending on temperature. To this end, a rigid compartment 20 is disposed underneath the opening mechanism 7 and contains a material 21, such as a wax, which expands when the temperature increases. When the laundry washing or dishwashing water or interior of the dryer is heated to the desired operating temperature, the wax 21 expands and pushes the opening mechanism 7 upwards, either directly or indirectly via a flexible diaphragm 22. In the same way as described with reference to the embodiment illustrated in FIGS. 1 and 2, this enables the opening mechanism 7 to open at least one of the respective compartments 5, e.g., by means of a blade or tongue 13. As the wax 21 cools, the opening mechanism 7 is duly lowered and is moved into the next position, for example by means of a zig-zag mechanism as described above. For the sake of simplification, this mechanism is not illustrated in the schematic diagrams of FIGS. 6 and 7. The described temperature-dependent system is particularly well suited for use in a dryer if it is desirable for the release of the compartment contents to be delayed or in a dishwasher which does not have a rotating drum.

In an alternative embodiment (which is not illustrated), the system may also be activated on the basis of temperature by providing a bimetallic strip, which bends as the temperature increases, thereby directly or indirectly raising the opening mechanism in the same manner as the wax 21 described above. On cooling, the bimetallic strip likewise returns to its initial shape so that the opening mechanism can be guided into its new position.

In the case of dishwashers, the temperature is normally increased twice during a dishwashing cycle, namely once during the cleaning cycle and a second time during the rinsing cycle. The temperature-dependent embodiments of the system proposed by the invention would therefore be activated twice, i.e., an appropriate substance would be released into the dishwasher twice. This might be a rinsing agent in both cases. However, it would also be conceivable, as an alternative, to provide one compartment with a dishwashing detergent and one with a rinsing agent, so that the dishwashing detergent is dispensed during the washing cycle and the rinsing agent during the rinsing cycle.

It goes without saying that within the scope of the invention, other embodiments would also be conceivable. For example, instead of breaking the encasing material by means of a blade or tongue, it would be conceivable for the opening mechanism simply to press against a perforation that would tear under the effect of this pressure. This being the case, a stronger material could be used for the material encasing the compartment.

Figure 8:
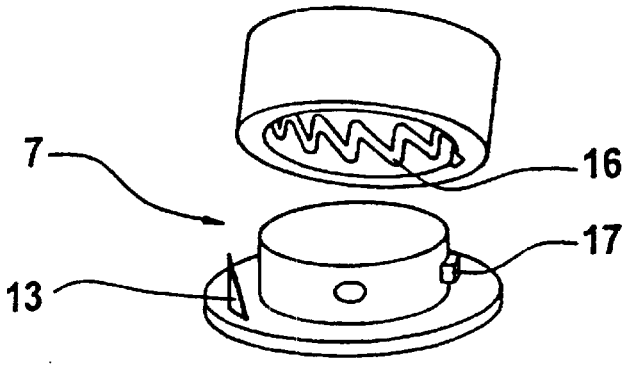
FIG. 8 is an enlarged, exploded, perspective view of the mechanism of the rotating blade for opening the individual compartments.

The described zig-zag mechanism of FIG. 8, where a nose 17 is guided in a key groove 16 of matching design as the opening mechanism is being raised and lowered into a position enabling the individual compartments of the apparatus to be opened, is also given solely by way of example, and a person skilled in this art would have no difficulty in finding other means that would fulfil the same purpose.

As an alternative, the invention also proposes that, instead of moving the actual opening mechanism (for example by means of the zig-zag mechanism illustrated in FIG. 8), it would be possible to move the compartments 5, by rotating the cartridge 4 for example, to permit another compartment to be opened by the opening mechanism 7, which would be stationary in this situation. Clearly, it would also be conceivable to displace both the opening mechanism 7 and the compartments 5 in order to move the opening mechanism 7 and the next compartment 5 to be opened into the correct position relative to one another.

The active composition(s) contained in the compartments may be of different types. In a laundry washing machine application, the compartments might contain detergent, water softener, fabric conditioner, etc., individually or in combination. In the case of dryers, it would be conceivable to use specific substances for impregnating and/or conditioning fabrics, for example. For dishwasher applications, dishwashing additives and rinsing agents could be used in particular.

Clearly, the active compositions contained in the compartments are not restricted to liquids. The compartments could also contain a pasty, granular or powdered material or alternatively a composition in tablet format. When the material encasing the compartments is torn, laundry washing or dishwashing liquid (at least in washing machine or dishwasher applications) would then penetrate the compartment and dissolve or rinse out the composition disposed in it. This could have an additional advantage over liquids since the contents could be released on a delayed basis.

It is of advantage to provide means for inactivating the apparatus, preferably of the type which do not have to be removed from the machine, so that the user can decide whether to run the machine with the apparatus proposed by the invention in the activated state or in the non-activated state. Any type of locking mechanism that would prevent the opening mechanism 7 from being raised could be used for this purpose, preferably a system of locking the release mechanism 6 or the cartridge 4.

The features of the invention disclosed in the above description, the drawings and the claims may be construed as essential to the realization of the invention in its various embodiments, both individually and in any combination.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for holding and dispensing metered doses of at least one active composition into a laundry washing, drying or dishwashing machine, comprising at least two separate compartments (5) for respectively receiving and dispensing at least one active composition, a mechanism (7) for opening the compartments (5), the opening mechanism (7) being operated by means inside the apparatus that are activated by a condition prevailing in an interior of the machine which occurs exclusively during a washing, drying or dishwashing cycle, and means for altering a position of the opening mechanism (7) and/or the compartment(s) (5) relative to one another after at least one of the compartments (5) has been emptied of active composition, such that at least one other of the compartments (5) may be opened by a subsequent activation of the opening mechanism (7).

2. The apparatus as claimed in claim 1, wherein the means for operating the opening mechanism (7) comprises a first bellows (8); a second bellows (11); a connecting pipe (10) with a one-way valve (12) which connects the two bellows (8, 11) to one another; and a hydraulic fluid (9) which is released from the first bellows (8) into the second bellows (11) causing the second bellows to expand, wherein the opening mechanism (7) is connected to the second bellows (11) in such a way that the opening mechanism (7) is raised due to expansion of the second bellows (11), wherein the opening mechanism (7) is so designed that its raising causes at least one of the compartments (5) to open to a degree that the active composition in the compartment is substantially entirely dispensed into the machine; and further comprising means (14) for enabling the hydraulic fluid (9) gradually to leave the second bellows (11) and a return mechanism (15) connected to the opening mechanism (7) which enables the opening mechanism (7) to be re-positioned as the hydraulic fluid (9) gradually leaves the second bellows (11), such that the opening mechanism (7) is guided into a position where at least one other of the compartments (5) can be opened in a similar manner by the subsequent activation.

3. The apparatus as claimed in claim 2, wherein the release of hydraulic (9) fluid from the first bellows (8) to the second bellows (11) is operated, directly or indirectly, by rotation of the apparatus with a drum of the machine.

4. The apparatus as claimed in claim 3, further comprising a pivotably secured weight (18) adapted to compress the first bellows (8) as the apparatus is rotated with the drum, thereby causing the hydraulic fluid (9) to be released to the second bellows (11).

5. The apparatus as claimed in claim 3, wherein the first bellows (8) is adapted to be compressed directly or indirectly by wet or dry laundry in the machine, thereby causing the hydraulic fluid (9) to be released to the second bellows (11).

6. The apparatus as claimed in claim 1, wherein the means for operating the opening mechanism (7) comprises means (20, 21, 22) adapted to alter in form, at least to a certain degree, when a temperature in the machine is increased, such that the opening mechanism (7) is raised, directly or indirectly, until at least one of the compartments (5) has been opened wide enough for the active composition in the compartment to be essentially entirely released into the machine, and wherein the means (20, 21, 22) is adapted to undergo a reverse change of form, at least to a certain degree, on cooling, such that the opening mechanism (7) is guided into a position where at least one other of the compartments (5) can be opened in a similar manner by the subsequent activation.

7. The apparatus as claimed in claim 6, wherein the means adapted to alter in form comprises a rigid compartment (20) with a material (21) disposed therein which expands as the temperature increases and shrinks on cooling.

8. The apparatus as claimed in claim 7, wherein the material (21) comprises a wax.

9. The apparatus as claimed in claim 7, wherein the means adapted to alter in form further comprises a flexible diaphragm (22), which responds to the expansion of the material (21), thereby raising the opening mechanism (7).

10. The apparatus as claimed in claim 6, wherein the means adapted to alter in form comprises a bimetallic strip, which bends when the temperature increases and returns to shape on cooling.

11. The apparatus as claimed in claim 1, wherein the means for altering a position comprises a key groove (16) and a nose (17) co-operating therewith to guide the opening mechanism (7) into a new position.

12. The apparatus as claimed in claim 1, wherein the opening mechanism (7) has at least one blade or a tongue (13) for opening the compartments.

13. The apparatus as claimed in claim 1, wherein the apparatus is firmly but detachably secured in an interior of the machine.

14. The apparatus as claimed in claim 1, wherein the apparatus has a cartridge (4) containing four to fifteen of the compartments (5).

15. The apparatus as claimed in claim 14, wherein the cartridge (4) contains ten of the compartments (5).

16. The apparatus as claimed in claim 14, wherein the compartments (5) are laid out in a circular arrangement in the cartridge (4).

* * * * *